US010445950B1

(12) United States Patent
De et al.

(10) Patent No.: US 10,445,950 B1
(45) Date of Patent: Oct. 15, 2019

(54) VEHICLE MONITORING SYSTEM

(71) Applicant: Uber Technologies, Inc., San Francisco, CA (US)

(72) Inventors: Nirveek De, San Bruno, CA (US); Dhruv Tyagi, San Francisco, CA (US); Joseph Sullivan, Palo Alto, CA (US); Karim Wahba, San Francisco, CA (US); Theodore Sumers, San Francisco, CA (US); Andrew Beinstein, San Francisco, CA (US); Gang Su, San Francisco, CA (US)

(73) Assignee: Uber Technologies, Inc., San Francisco, CA (US)

( * ) Notice: Subject to any disclaimer, the term of this patent is extended or adjusted under 35 U.S.C. 154(b) by 59 days.

(21) Appl. No.: 15/470,714

(22) Filed: Mar. 27, 2017

(51) Int. Cl.

| | |
|---|---|
| ***G07C 5/00*** | (2006.01) |
| ***G07C 5/02*** | (2006.01) |
| ***G07C 5/08*** | (2006.01) |

(52) U.S. Cl.
CPC ..... *G07C 5/006* (2013.01); *G07C 5/008* (2013.01); *G07C 5/02* (2013.01); *G07C 5/0808* (2013.01); *G07C 5/0825* (2013.01); *G07C 5/0833* (2013.01); *G07C 5/0841* (2013.01); *G07C 2205/02* (2013.01)

(58) Field of Classification Search
CPC .... G07C 5/006; G07C 5/0841; G07C 5/0833; G07C 5/0808; G07C 5/02; G07C 5/008; G07C 5/0825; G07C 2205/02
See application file for complete search history.

(56) References Cited

U.S. PATENT DOCUMENTS

| | | | |
|---|---|---|---|
| 6,195,648 | B1 | 2/2001 | Simon |
| 6,263,435 | B1 | 7/2001 | Dondeti |
| 8,010,285 | B1 | 8/2011 | Denise |
| 8,417,448 | B1 | 4/2013 | Denise |
| 8,417,449 | B1 | 4/2013 | Denise |
| 8,538,158 | B1 | 9/2013 | Denise |
| 8,670,930 | B1 | 3/2014 | Denise |
| 8,718,926 | B1 | 5/2014 | Denise |
| 8,915,738 | B2 | 12/2014 | Mannino |
| 8,924,240 | B2 | 12/2014 | Depura et al. |
| 8,934,719 | B1 | 1/2015 | Denise |

(Continued)

FOREIGN PATENT DOCUMENTS

| | | |
|---|---|---|
| EP | 1156462 | 11/2005 |
| EP | 2767962 | 8/2014 |

(Continued)

OTHER PUBLICATIONS

International Search Report and Written Opinion in PCT/US2017/037421 dated Aug. 31, 2017.

(Continued)

*Primary Examiner* — Yuen Wong
(74) *Attorney, Agent, or Firm* — Mahamedi IP Law LLP

(57) ABSTRACT

Examples provide for a computing system to obtain sensor data of one or more types, from one or more sensor components of a computing device associated with a user of the vehicle. The sensor data reflects an attribute of the vehicle's operation when the computing device is carried within or in proximity to the vehicle during the vehicle's operation. One or more characterizations may be determined for the vehicle based on the sensor data.

20 Claims, 5 Drawing Sheets

(56) References Cited

U.S. PATENT DOCUMENTS

| | | | | |
|---|---|---|---|---|
| 9,097,545 | B1 | 8/2015 | Denise | |
| 9,898,759 | B2 | 2/2018 | Khoury | |
| 2008/0252412 | A1 | 10/2008 | Larsson | |
| 2008/0255722 | A1 | 10/2008 | McClellan | |
| 2009/0088924 | A1 | 4/2009 | Coffee | |
| 2009/0192851 | A1 | 7/2009 | Bishop | |
| 2009/0234552 | A1 | 9/2009 | Takeda | |
| 2010/0020170 | A1 | 1/2010 | Higgins-Luthman | |
| 2010/0136994 | A1 | 6/2010 | Kim | |
| 2011/0000747 | A1 | 1/2011 | Wu | |
| 2011/0301806 | A1 | 12/2011 | Messier | |
| 2011/0301985 | A1 | 12/2011 | Camp | |
| 2012/0174111 | A1 | 7/2012 | Pala | |
| 2012/0191343 | A1 | 7/2012 | Haleem | |
| 2012/0232741 | A1 | 9/2012 | Sekiyama | |
| 2012/0232943 | A1 | 9/2012 | Myr | |
| 2012/0283893 | A1 | 11/2012 | Lee | |
| 2013/0005414 | A1 | 1/2013 | Gurbrinder et al. | |
| 2013/0066688 | A1 | 3/2013 | Pinkus | |
| 2013/0226622 | A1 | 8/2013 | Adamson | |
| 2013/0311081 | A1 | 11/2013 | Yamakawa | |
| 2013/0345961 | A1 | 12/2013 | Leader | |
| 2014/0051465 | A1 | 2/2014 | Ruys et al. | |
| 2014/0067434 | A1 | 3/2014 | Bourne et al. | |
| 2014/0129951 | A1 | 5/2014 | Amin et al. | |
| 2014/0207342 | A1 | 7/2014 | Chen et al. | |
| 2014/0358376 | A1 | 12/2014 | Phelan | |
| 2015/0095235 | A1 | 4/2015 | Dua | |
| 2015/0100505 | A1* | 4/2015 | Binion | G07O 5/008 705/306 |
| 2015/0106900 | A1 | 4/2015 | Pinski | |
| 2015/0113622 | A1 | 4/2015 | Dua | |
| 2015/0223024 | A1 | 8/2015 | Abuodeh | |
| 2015/0266455 | A1 | 9/2015 | Wilson | |
| 2015/0279213 | A1 | 10/2015 | Balter | |
| 2015/0302342 | A1 | 10/2015 | Yeh | |
| 2015/0307107 | A1 | 10/2015 | Tamari | |
| 2015/0348221 | A1 | 12/2015 | Pedersen | |
| 2016/0358388 | A1 | 12/2016 | Skoglund | |
| 2017/0132540 | A1 | 5/2017 | Haparnas | |
| 2017/0371608 | A1 | 12/2017 | Wasserman | |
| 2017/0372534 | A1* | 12/2017 | Steketee | G06Q 10/087 |
| 2018/0086347 | A1 | 3/2018 | Shaikh | |
| 2018/0089605 | A1 | 3/2018 | Poornachandran | |

FOREIGN PATENT DOCUMENTS

| | | |
|---|---|---|
| EP | 2700063 | 6/2015 |
| JP | 2014-130552 | 6/2014 |
| KR | 10-2014-0124137 | 10/2014 |
| WO | WO2012080741 A1 | 6/2012 |

OTHER PUBLICATIONS

International Search Report and Written Opinion in PCT/US2016/026799 dated Jul. 28, 2016.
International Search report in PCT/US2016/016858 dated May 19, 2016.
IPRP in PCT/2016/016858 dated Aug. 17, 2017.
Written Opinion issued in SG 11201708199T dated May 7, 2018.
IPRP in PCT/US2016/026799 dated Oct. 17, 2017.
IPRP in PCT/US2017/037421 dated Dec. 27, 2018.

* cited by examiner

VEHICLE MONITORING SYSTEM

BACKGROUND

In recent years, on-demand services have been increasingly in use, where individuals can utilize a network service to coordinate, provide, or receive services. In the context of on-demand transportation services, users operate their own vehicles. Vehicles may tend to require more maintenance, and suffer degradation more quickly than what would be expected. Service providers may not always have the benefit of professional oversight and evaluation of their vehicles. As such, many routine maintenance issues may go undiagnosed, resulting in deterioration of the vehicle and the service provided through the network service.

DETAILED DESCRIPTION

Figure 1:
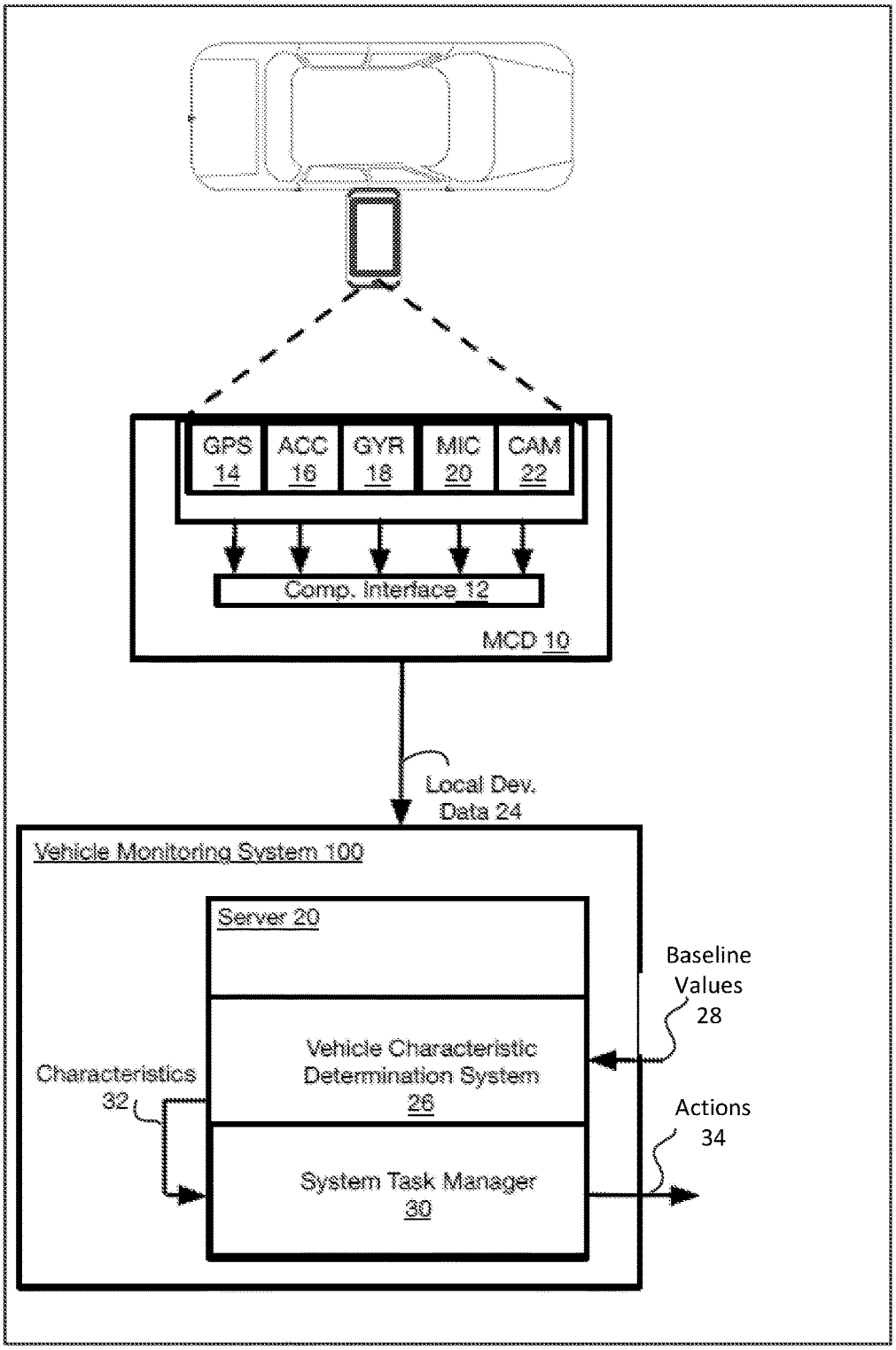
FIG. 1 illustrates an example computer system to evaluate a vehicle using data generated from components of a mobile computing device, according to one or more embodiments.

Networked systems can provide a number of services, such as coordinating services between service providers and services requestors. For instance, a particular networked system coordinates transportation between drivers and riders, each carrying their own smartphone. Each driver has an account that associates the driver with a particular make and model of a vehicle. The vehicle may go through in inspection process before the driver is permitted to use the networked system. The inspection process can be used to verify that the vehicle meets certain reliability, comfort, and safety factors. In such a case, verifying that that the driver is actually using the same vehicle registered with the driver's account can improve the networked system. Moreover, detecting that the vehicle is in safe operating condition can improve the network system. Example systems and methods described herein can provide for a computing system that obtains one or more types of sensor data from corresponding sensor components of a computing device associated with a user of the vehicle. The sensor data may reflect an attribute of the vehicle's operation when the computing device is carried within or in proximity to the vehicle during the vehicle's operation. One or more characterizations may be determined for the vehicle based on the sensor data, reflecting, for example, a quality of the vehicle, a service level or service type which may be provided with the vehicle, a maintenance level of the vehicle, and/or a performance or safety level of the vehicle. In variations, the determined characterization can include a classification, corresponding to a vehicle type, a vehicle manufacturer, an age of the vehicle, or other classifications such as a maintenance state of the vehicle. Thus, the computing system can be used to identify the vehicle or determine its health.

In some variations, the network computing system can select and implement one or more tasks for a service provider or user associated with a vehicle, based on the determined characterization of the vehicle. According to some examples, a network computing system may operate to detect performance issues (e.g., engine deterioration, vehicle defects, or the need for repair and/or maintenance) with vehicles of service providers. Examples may further determine a task or action to provide awareness to the vehicle operator (e.g., service provider) of maintenance, performance or safety issues, as well as to facilitate the vehicle operator in addressing the issue with the vehicle.

An example described herein utilizes mobile computing devices which execute service applications to obtain sensor data that indicates operational attributes of the vehicle. The evaluation of the vehicle using a mobile computing device of a vehicle operator (or other occupant) may be automated (e.g., without human intervention) and responsive to predetermined conditions or triggers that can be selected for a user of a variety of purposes. In this way, examples enable a vehicle's maintenance state, for example, to be monitored in order to prompt the vehicle operators to service their vehicles, even when a vehicle's maintenance issue may not be readily apparent to the operator.

One or more examples described provide that methods, techniques, and actions performed by a computing device are performed programmatically, or as a computer-implemented method. Programmatically, as used, means through the use of code or computer-executable instructions. These instructions can be stored in one or more memory resources of the computing device. A programmatically performed step may or may not be automatic.

One or more examples described can be implemented using programmatic modules, engines, or components. A programmatic module, engine, or component can include a program, a sub-routine, a portion of a program, or a software component or a hardware component capable of performing one or more stated tasks or functions. As used herein, a module or component can exist on a hardware component independently of other modules or components. Alternatively, a module or component can be a shared element or process of other modules, programs, or machines.

Some examples described can use specialized computing devices, including processing and memory resources. For example, one or more examples described may be implemented, in whole or in part, on computing devices such as servers, desktop computers, cellular or smartphones, personal digital assistants (e.g., PDAs), laptop computers, printers, digital picture frames, network equipment (e.g., routers), wearable computing devices, and tablet devices. Memory, processing, and network resources may all be used in connection with the establishment, use, or performance of any example described herein (including with the performance of any method or with the implementation of any system). For instance, a computing device coupled to a data storage device storing the computer program and configured to execute the program corresponds to a special-purpose computing device. Furthermore, any computing systems referred to in the specification may include a single processor or may be architectures employing multiple processor designs for increased computing capability.

Furthermore, one or more examples described may be implemented through the use of instructions that are executable by one or more processors. These instructions may be carried on a computer-readable medium. Machines shown or described with figures below provide examples of processing resources and computer-readable mediums on which instructions for implementing examples described can be carried and/or executed. In particular, the numerous machines shown with examples described include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash memory (such as carried on smartphones, multifunctional devices or tablets), and magnetic memory. Computers, terminals, network enabled devices (e.g., mobile devices, such as cell phones) are all examples of machines and devices that utilize processors, memory, and instructions stored on computer-readable mediums. Additionally, examples may be implemented in the form of computer-programs, or a computer usable carrier medium capable of carrying such a program.

System Description

FIG. 1 illustrates an example computer system that evaluates a vehicle using data generated from components of a mobile computing device, according to an embodiment. As illustrated, a vehicle monitoring system 100 can be implemented on a server 20, combination of servers, or other network computer system, to communicate with a mobile computing device 10 of a service provider operating a vehicle 1. The vehicle monitoring system 100 receives local device data 24, generated from the mobile computing device 10 when it is positioned within or in proximity of a target vehicle 1. While the vehicle monitoring system 100 is shown in FIG. 1 as being implemented on a server 20 (or combination of servers), it will be appreciated that a number of components and/or functions as described with the vehicle monitoring system 100 may be deployed in alternative computing environments. For example, the vehicle monitoring system 100 can be implemented as a computer program stored on computer memory coupled to a processor within the server(s) 20, the mobile device 10, or both server and mobile device 10.

Figure 2:
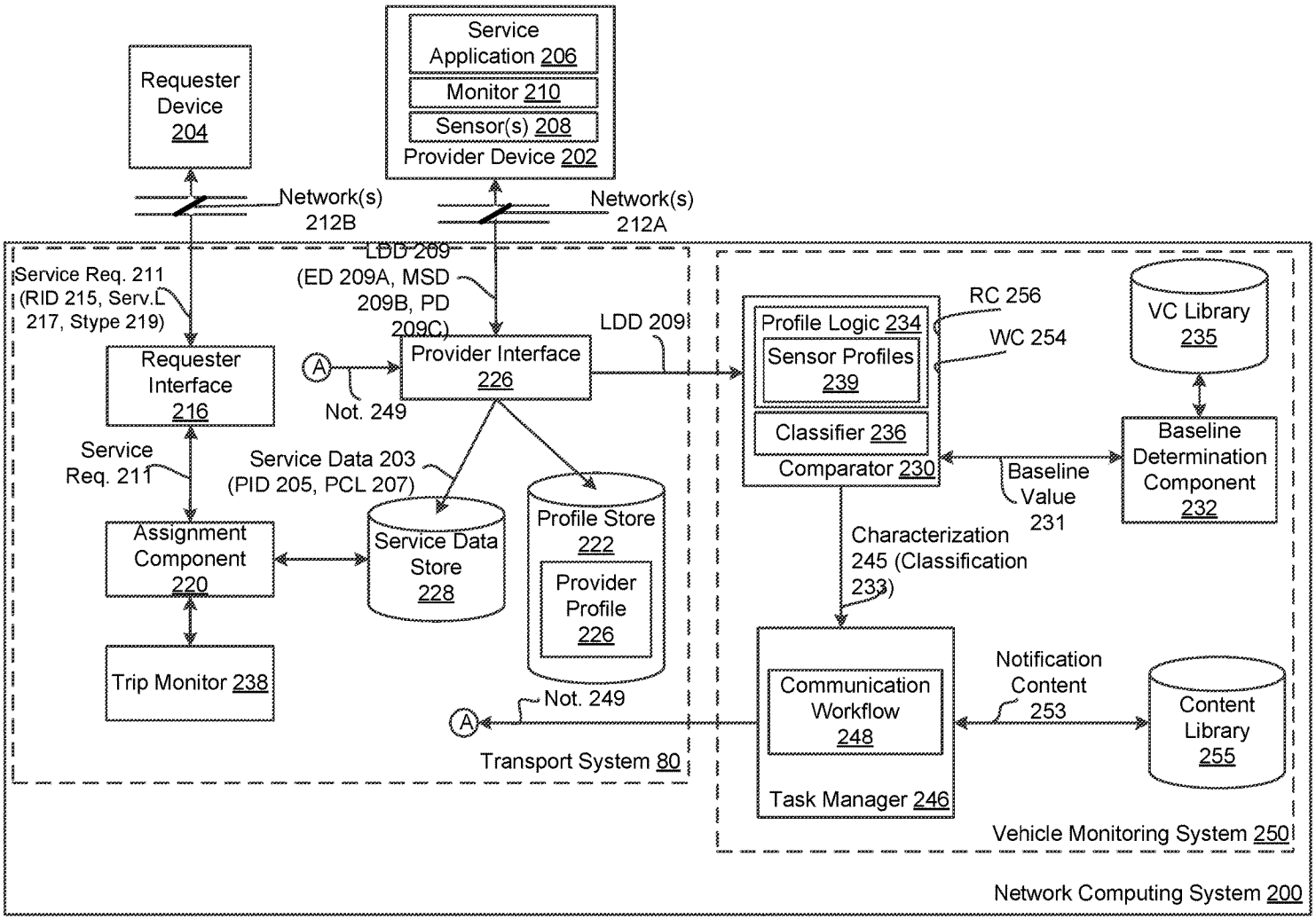
FIG. 2 illustrates an example network computing system, in accordance with examples described herein, to provide a vehicle monitoring system in connection with a transport related service.

In some examples, the mobile computing device 10 includes a component interface 12 to receive sensor data of one or more types. By way of example, the component interface 12 receives sensor data from one or more of a GPS component 14, accelerometer 16, gyroscope 18, microphone 20, camera 22, or other sensor based components. The mobile computing device 10 communicates multiple types of sensor data, shown as local device data 24, to a vehicle characteristic determination system 26. The vehicle characteristic determination system 26 compares the local device data 24 with a set of baseline values 28 that are associated with, or otherwise selected for the vehicle 1, in order to determine a set of characterizations 32 for the vehicle 1. The vehicle characteristic determination system 26 may also include a system task manager 30 to determine one or more actions 34 which can be initiated and/or performed based on the determined characterizations 32. The actions 34 can include programmatically initiated actions, such as those which may be initiated by a network computing system 200 (as shown in FIG. 2). In variations, the actions 34 can be identified and communicated to the operator of the vehicle 1 in the form of one or recommendations to repair or prevent damage to the vehicle.

By way of example, the characterizations 32 may be indicative of the vehicle's operability, usability, and/or performance. In some examples, the characterizations 32 may correspond to a quantitative determination or classification which reflects one or more of a quality of the vehicle, a service level or service type which may be provided with the vehicle, a maintenance level of the vehicle, and/or a performance or safety level of the vehicle. In variations, the characterizations 32 can include one or more classifications which correspond to a vehicle type, a vehicle manufacturer, an age of the vehicle, or other classifications such as a maintenance state of the vehicle. In some examples, the vehicle monitoring system 100 determines characterizations 32 of the vehicle 1 that are indicative of a need for repair or maintenance. Still further, the vehicle monitoring system 100 may detect characterizations 32 of vehicle 1 that are indicative of a changed condition of the vehicle. In variations, the vehicle monitoring system 100 determine characterizations 32 based on a detected condition of the vehicle's operation. The characterizations 32 determined by the vehicle monitoring system 100 may also quantify or classify the detected condition, so that a severity of the condition is also indicated by an output of the vehicle monitoring system 100. Still further, in variations, the characterizations 32 may correspond to a classification and/or quantitative determination regarding one or more operational characteristics of a monitored vehicle, such as a desired set of qualities (e.g., comfort, vehicle performance) for a vehicle that is used in connection with transport related services. In specific examples, the characterizations 32 may identify a quality of the vehicle, a service level or service type which may be provided with the vehicle, a maintenance level of the vehicle, and/or a performance or safety level of the vehicle. In variations, the vehicle characterization(s) 32 may identify a maintenance state of the vehicle, a degradation level of the vehicle, a vehicle type, a manufacturer of the vehicle, and/or an age of the vehicle.

In determining the characterizations 32, the vehicle characteristic determination system 26 may retrieve the baseline values 28 from memory. For example, the vehicle characteristic determination system 26 may retrieve the set of baseline values 28 from a collection of baseline values, or from a profile associated with the vehicle 1. In variations, the vehicle characteristic determination system 26 may obtain the baseline values 28 from the mobile computing device 10, or from another remote source.

In example embodiments, the types of sensor data which may be used with the vehicle monitoring system 100 may be controlled or otherwise selected based on the user settings of the mobile computing device 10. For instance, the vehicle monitoring system 100 may utilize sensor data in accordance with a setting or action which connotes the user's explicit permission for such data to be used by vehicle monitoring system 100.

The mobile device 10 can be associated with a provider, requester, owner, or other mobile device user who is in proximity to the vehicle. For instance, the mobile device 10 can correspond to a smart phone device storing a computer program for coordinating transportation services to be provided by a provider for a user requesting a ride. The mobile device 10 can execute a computer program that connects the mobile device 10 to the network system and makes the user available for providing the transportation services. The computer program links the user to a user account that stores information about the user's vehicle, such as make and model of the vehicle, as well as vehicle usage and health information.

In operation, vehicle monitoring system 100 receives and processes data that is generated, or otherwise based on readings from one or more sensors of a mobile computing device 10 that is situated within, or in close proximity to a vehicle under evaluation. For instance, the components 14-22 of mobile device 10 can provide measurements of the vehicle under evaluation to vehicle monitoring system 100. The vehicle monitoring system 100 can implement processes and other logic to process the local device data 24 in order to make one or more characterizations 32 about the vehicle.

The vehicle monitoring system 100, in an example embodiment, is "remote" in the sense that it is not a monitoring system integrated within the vehicle. In an example embodiment, the vehicle monitoring system 100 can perform its functions wirelessly communicating with a mobile computing device (e.g., of the vehicle's operator) carried within or near the vehicle.

As stated above, vehicle monitoring system 100 receives multiple types of sensor data ("local device data 24") from the mobile computing device 10. The local device data 24 may be generated from components of mobile computing device 10, including sensor components (e.g., accelerometer, gyroscope, microphone, camera, and/or the like), WiFi, and/or GPS components of the mobile computing device 10. According to some examples, the local device data 24 can be analyzed to determine a set of characterizations 32 of the vehicle 1, as described in greater detail.

In example embodiments, the vehicle monitoring system 100 implements or causes local operations on the mobile computing device 10 in order to control the acquisition of the local device data 24. For example, a service application may execute background tasks to cause particular sensors to generate sensor data; obtain (e.g., through accessing and/or sampling of the sensor data) the local device data 24; and transmit or provide the local device data 24 to the vehicle monitoring system 100.

Among other examples, the vehicle monitoring system 100 determines the characterizations 32 to trigger or initiate actions to promote vehicle maintenance and repair amongst service providers, particularly those who provide on-demand transport or other transportation related services. By way of example, vehicle monitoring system 100 can operate to evaluate and monitor vehicles used by service providers who provide on-demand transport, food and package delivery services, and/or trucking services. According to some examples, the vehicle monitoring system 100 initiates and/or plans actions to facilitate maintenance and repair of the vehicles.

In some examples, the vehicle monitoring system 100 identifies characterizations 32 in real-time, in response to changes in the vehicle which impact performance or other metric. In such examples, the vehicle monitoring system 100 can initiate and/or implement preventative or remedial actions automatically. In some variations, the vehicle monitoring system 100 can automatically initiate and/or implement one or more remedial actions in response to a separate determination that the vehicle would benefit from repair or maintenance.

In such examples, the vehicle monitoring system 100 can select actions 34 to correspond to maintenance or repair operations that are specific to characterizations 32 corresponding to, for example, make, model, type and/or age of the vehicle. In other variations, the actions 34 can include implementing a verification process based on a determined classification for the vehicle 1, to verify that an operator is using a particular type of vehicle.

In example embodiments, the vehicle monitoring system 100 can monitor a vehicle in actual operating conditions using the mobile computing device 10. The monitoring of the vehicle during operation facilitates detecting characterizations 32 relating to the operation of the vehicle, which may be difficult to detect with routine conventional service checks of vehicles. For example, the vehicle monitoring system 100 can determine characterizations 32 relating to a comfort or quality of the vehicle 1, based on vibrational and/or acoustic attributes which are detected from the local device data 24.

The mobile computing device 10 may include logic (e.g., such as provided by a service application) that precludes the provider from accessing the vehicle monitoring system 100. By precluding the provider from accessing the vehicle monitoring system 100, a remote network service can evaluate the vehicle that the service provider is using, while minimizing the risk that the service provider will interfere with the evaluation of the service provider's vehicle. In this way, the evaluation of the service provider's vehicle may remain independent and free from influence by the service provider.

According to an example of FIG. 1, the vehicle monitoring system 100 can be implemented as a network service, or as part of a network service (e.g., as part of a transport arrangement service or package delivery arrangement service), using one or more servers which communicate with mobile devices of a population of providers. In example embodiments, the vehicle monitoring system 100 is implemented, in whole or in part, by a service application that executes on the mobile computing device 10 of the provider.

In one implementation, a user (e.g., provider) mounts or carries the mobile computing device 10 into the vehicle 1, in connection with the user providing or receiving a service using that vehicle 1. The user's mobile computing device 10 can be equipped with multiple types of data acquisition resources. In one implementation, the mobile computing device 10 includes one or more component interfaces 12 to read or otherwise interface with data acquisition sources, such as GPS component 14, accelerometer 16 (e.g., a 3-axis accelerometer), gyroscope 18, microphone 20, and/or camera 22. In this way, the local device data 24 can, for example, include position data and multiple types of sensor data.

In some examples, the local device data 24 can represent human perceptible attributes, corresponding to sensor-based measurements, of the vehicle's operation and/or interior environment. By way of examples, the attributes of the vehicle's operation can correspond to one or more of an acoustic attribute (e.g., noise level, type of noise, frequency), a motion attribute (e.g., vertical or lateral acceleration values) and/or a vibrational attribute (e.g., intensity or pattern of vehicle motion). The local device data 24 can be obtained from the sensor devices of the computing device repeatedly, over a given duration or time. Alternatively, the local device data 24 can be determined continuously when, for example, a vehicle is in use by a user acting as a service provider for a transportation related service.

In an example embodiment, the vehicle monitoring system 100 obtains the local device data 24 in response to detecting an occurrence of a pre-determined event. For example, operation of a vehicle in connection with providing a transportation related service can cause a remote network computer system to periodically trigger an evaluation of that user's vehicle using local device data 24. As another example, the vehicle evaluation may be triggered by a user's operation of the vehicle in connection with a transport related service, specifically after when the user receives a low score or negative feedback from a passenger who received the transport service, among other examples of triggers.

In some examples, the local device data 24 can be subjected to post-acquisition processes, which may be performed on the mobile computing device 10 or on a server or remote computer system. In some examples, the post-acquisition processes include an averaging process to normalize the local device data 24. As an addition or variation, the local device data 24 can be subjected to a filtering process, such as a process to filter out noise. The noise data can include any data which is unrelated to the vehicle attributes of interest, such as accelerometer or gyroscope data which is attributable to the user handling the mobile computing device 10 while driving within the vehicle 1. Examples of filtering includes frequency rejection filtering (e.g., low-pass or bandpass filtering) or state estimation filtering (e.g., one or more integration filters to convert acceleration to velocity of position information, Kalman filtering for data fusion for state estimation, or the like).

In an example embodiment, the vehicle characteristic determination system 26 receives local device data 24 and baseline values 28 as inputs and provides characterization 32 as output. More specifically, the determination can based on comparisons of the local device data 24 with one or more sets of baseline values 28. For example, the vehicle characteristic determination component 26 can obtain baseline values 28 which can be correlative to characteristics which are indicative of performance, degradation level, age, as well as manufacturer or vehicle type. Based on a comparison of the baseline values 28 to the collected local device data 24, the vehicle characteristic determination component 26 can determine one or more characterizations 32, (e.g., vehicle's performance, degradation level, age, manufacturer, vehicle type, etc.).

In some examples, the vehicle characteristic determination component 26 may implement, or otherwise utilize a task manager 30 to select and perform actions 34 that are responsive to the determined characterizations 32. The system task manager 30 may, for example, perform actions 34 that include (i) prompting the provider to repair or seek maintenance for the vehicle, (ii) making safety determinations for the vehicle, and/or (iii) verifying user feedback that indicates poor vehicle quality.

The vehicle monitoring system 100 can trigger an output of the vehicle characteristic determination component 26 in response to, for example, feedback from a customer, indicating a vehicle's service state or quality is below an acceptable or expected threshold. In response to the output of the vehicle characteristic determination component 26, the task manager 30 can initiate one or more actions 34 to prompt an owner or user of the vehicle 1 to service or repair the vehicle 1.

In an example of FIG. 1, the system task manager 30 is shown as a system or component within the vehicle monitoring system 100. In other variations, the system task manager 30 can be implemented independently from the vehicle monitoring system 100. For example, the system task manager 30 can be implemented as an integrated component of a transport arrangement service, separate from vehicle monitoring system 100. While some examples are provided in context of a service provider (e.g., provider) and a corresponding mobile computing device, variations may also provide that another occupant's (e.g., requester) mobile device can be used to implement some or all of the functionality described with vehicle monitoring system 100.

Network Computing System

FIG. 2 illustrates an example of a network computing system 200 that employs a vehicle monitoring system 250, as described with some examples of FIG. 1, in connection with a transport arrangement service. The network computing system 200 is shown as being communicatively coupled to a provider device(s) 202 and a requester device(s) 204. The provider device 202 includes service application 206, monitor 216, and sensors 208A/B. The network computing system 200 includes a transport system 80 and the vehicle management system 250. In some examples, the network computing system 200 utilizes the vehicle monitoring system 250 to determine characterizations about a service provider's vehicle. The characterizations can be used to improve transport provided through the network computing system 200, by, for example, improving a quality or service level of the individual vehicles which are in use. The transport system 80 and vehicle management system 250 are described in greater detail below.

In some examples, the network computing system 200 and the devices 202, 204 connect to networks 212*a*, 212*b* to facilitate communications with mobile devices of users (e.g., requesters and providers) who provide or receive transport services. The networks 212*a*, 212*b* can include communication links using technologies such as Ethernet, 802.11, worldwide interoperability for microwave access (WiMAX), 3G, 4G, code division multiple access (CDMA), digital subscriber line (DSL), etc. Examples of networking protocols used for communicating via the networks 212*a*, 212*b* include multiprotocol label switching (MPLS), transmission control/protocol/Internet protocol (TCP/IP), hypertext transport protocol (HTTP), simple mail transfer protocol (SMTP), and file transfer protocol (FTP). Data exchanged over the networks 212*a*, 212*b* are represented using any format, such as, but not limited to, hypertext markup language (HTML) or extensible markup language (XML). In some embodiments, all or some of the communication links of the networks 212*a*, 212*b* are encrypted. The network computing system 200 may be implemented in conjunction with service applications 206 which execute on mobile computing devices 202, 204 of requesters and providers.

The vehicle monitoring system 250 operates in combination with the service application 206 of the provider device 202 (or requester device 204) to provide vehicle monitoring functionality, as described with an example of FIG. 1 and in further detail below. When a vehicle is used to provide a transport service (or is associated or a part of the transport service), the service application 206 of the corresponding provider device 202 is executed to obtain sensor and position data (e.g., "local device data 209"). The service application 206 may execute to obtain and transmit the local device data 209 when, for example, the provider is in the process of providing a service to a requester, or more generally, after some pre-determined event (e.g., provider receives a low rating or poor feedback). As another example, the service application 206 may be triggered to obtain and transmit local device data 209 in response to a determination that the provider device 202 is carried by the provider inside a vehicle when the provider is available to provide transport related services, or simply when the vehicle is being driven by the provider.

As described with various examples, the vehicle monitoring system 250 processes the local device data 209 to (i) determine (e.g., quantitatively) a characterization 245 of the vehicle's operation, such as a characterization that is relevant to the transport related service (e.g., comfort, performance, etc.) and/or (ii) determine characterizations 245 which are inherent characteristics of the vehicle (e.g., vehicle model, year, type, etc.). In specific examples the characterizations 245 may be specific to a type of service which the vehicle is used to provide. Accordingly, the characterizations 245 may identify, for example, a performance level, a service level (e.g., whether the vehicle requires servicing or maintenance to mitigate degradation of vehicle operation), a quality (e.g., whether a vehicle operates as luxury class, comfort level), a manufacturer, a vehicle type, and/or other vehicle characterizations which are relevant to the type of transport related service being provided through the vehicle.

Additionally, in some examples, the vehicle monitoring system 250 can trigger the provider device 202 (via the service application 206) to perform or initiate one or more remedial actions to service the vehicle, including actions performed by the network computing system 200 and/or actions with respect to maintenance or servicing of the vehicle.

Transport Arrangement Services

The network computing system 200 may integrate the vehicle monitoring system 250 with components of the transport system 80. The transportation system 80 of the illustrated embodiment includes a requester interface 216, a provider interface 226, an assignment component 220, a profile store 225, and a service data store 228. In some examples, multiple computing devices of users (e.g., providers and/or requesters) may be in communication with the network computing system 200 to provide and/or receive transportation related services.

In an example shown with FIG. 2, provider device 202 is shown to communicate with network computing system 200 using the service application 206. The service application 206 may correspond to a program (e.g., a set of instructions or code) that is downloaded and stored on the mobile device from, for example, network computing system 200 and/or an "app" store. For example, the service application 206 can correspond to a requester client application to enable a requester user (requester) to view information about a network service and to make a request for a location-based service. In other examples, the service application 206 may correspond to a provider client application to enable a service provider (provider) to receive invitations for providing services from the service arrangement system.

A provider can launch and operate the service application 206 on their provider device 202, in order to utilize the network computing system 200 and operate an associate vehicle as a service provider. According to an example, the service application 206 can launch on the provider device 202 to establish a communication channel with the provider device 202. The provider device 202 may ephemerally, intermittently, repeatedly, or continuously communicate service information 203 to the network computing system 200. The service data 203 may include the provider's identifier 205, and the provider's current location 207. The current location 207 may be transmitted from the provider device 202 independently of, for example, sensor information (e.g., such as accelerometer data, gyroscope data, barometer data, microphone data etc.).

The network computing system 200 can communicate with the service application 206 on the provider device 202 through the provider interface 226. The provider device interface 226 may perform processes such as linking the provider device 202 to an account. The provider interface 226 enables the service application 206 on the provider device 202 to exchange data with the network computing system 200 and/or vehicle monitoring system 250. For example, the provider interface 226 can use a network resource of the provider device 202 to exchange communications with the network computing system 200 and the vehicle monitoring system 250 over one or more wireless networks (e.g., wireless networks 212*a* and/or 212*b* via, for example, a cellular transceiver, a WLAN transceiver, etc.). The provider interface 226 can include or use an application programming interface (API), such as an externally provider-facing API, to communicate data with provider device 202. The externally facing API can provide access to the provider device 202 via secure access channels over the network through any number of methods, such as web-based forms, programmatic access via RESTful APIs, Simple Object Access Protocol (SOAP), remote procedure call (RPC), scripting access, etc.

When the provider device 202 initiates a session with the transport arrangement service, the provider interface 226 may receive the service information 203 (including the provider identifier 205 and the provider current location 207) and store the service information in a service data store 228. For each active provider at a given time interval, the service data store 228 identifies a service state of the provider (e.g., available, assigned to request, on-trip, etc.), as well as the current location 207 of the provider. The provider interface 226 may also provide or indicate the provider's service state, which initially may be 'available' and then change when requests are assigned to the provider.

In example embodiments, the service application 206 controls data that the service application 206 has access to in a number of ways. For example, the provider interface 226 and the service application 206 transfer data in accordance with permission settings controlled by the user that indicates limitations on the types of sensor data that can collected and when sensor data can be collected. For instance, the user can completely shut off data collection by the service application 206. While example embodiments are described herein in the context of the service application 206 as controlling access to sensor data and controlling transmission of sensor data to the provider interface, it will be appreciated that these functions can be performed, wholly or in part, by any suitable component of provider device 202 or network computing system 200.

Additionally or alternatively, the service application 206 controls data collection with respect to predetermined events that trigger data collection and analysis. For instance, the service application 206 monitors sensor data from the provider device 202 to determine whether the vehicle performed a maneuver matching a predetermined event, such as acceleration from a stop, deceleration to a stop, a right turn, a left turn, running in idle for a period of time, and/or the like. The service application 206 can detect events by processing the sensor data (e.g., accelerometer and/or gyroscope sensor data) based on a predetermined event profile. In response to detecting that an event occurred, the service application 206 can provide the provider interface 226 sensor data that corresponds to particular types of sensor data for a time period corresponding to the event.

For example, in response to detecting idling, the service application 206 provides the provider interface 226 sensor data corresponding to at least accelerometer and microphone sensor data captured during the idle event. In another example, in response to detecting turning, the service application 206 provides the provider interface 226 sensor data corresponding to at least accelerometer, gyroscope, and microphone sensor data captured during the turn. In yet another example, in response to detecting acceleration/deceleration, the service application 206 provides the provider interface 226 sensor data corresponding to at least accelerometer, gyroscope, and microphone sensor data captured during the acceleration/deceleration.

In one implementation, a user can operate the service application 206 on requester device 204 to receive transport. The service application 206 may execute on the requester device 204 to enable the user to make a service request 211. The service request 211 can specify, for example, the requester's identifier 215, a service location (e.g., pickup or drop-off location) 217, and a service type or level 219.

The network computing system 200 uses the requester interface 216 to receive the service request 211. The requester interface 216 can include or use an API, such as an externally requester-facing API, to communicate data with requester device 204. The externally facing API can provide access to the requester device 204 via secure access channels over the network through any number of methods, such as web-based forms, programmatic access via RESTful APIs, SOAP, RPC, scripting access, etc.

The service assignment component 220 responds to the service request 211 (e.g., the requester identifier 215, the service location 217, and the service type or level 219) by selecting a provider for the service request 211. When the selection is made, the assignment component 220 can update the service data store 228 to reflect the assignment of the service provider to the service request 211, as well as to update the service state for the service provider. For example, the assignment component 220 may update the provider's service state to reflect the provider as being assigned to the particular service request 211, and further that the provider is en route to the service location 217. The provider interface 226 (and/or the requester interface component 216) may also update the current location 207 of the service provider as the service provider progresses to the service location 217. Once the trip begins, the location of the vehicle can be determined from the provider device 202 and/or the requester device 204. The service state of the provider may also be changed to reflect the provider as being on-trip for the duration until the trip is complete.

In example embodiments, network computing system 200 includes the profile store 222 that includes profile information ("provider profile 225") about the users, including the provider and requester. The provider profile 225 can also identify information about a vehicle associated with the provider. Among other information, the provider profile 225 can identify the vehicle the provider operates by make, model, type, and/or age (or year of manufacturing). In some examples, the profile store 222 can also store information about the maintenance or operating state of the provider's vehicle. For example, the profile store 222 can store, as profile information 225, characterizations 245 generated by the vehicle monitoring system 250 in one or more prior instances in which the vehicle was evaluated. Thus, for example, the provider profile 225 can store historical information reflecting outcomes of prior evaluations performed by the vehicle monitoring system 250.

Vehicle Monitoring Sub-System

In the context of transport related services, some examples provide for the use of local device data 209 generated from the provider device 202 by default. Accordingly, some examples, such as described below, are specific to implementations in which local device data 209 is obtained from the provider device 202. In some variations, however, local device data 209 can be obtained from other devices that are situated within or near the vehicle, including the requester device 204. With respect to an example of FIG. 2, the service application 206 can execute on the provider device 202 as a client or network-based application, to implement functionality for communicating with network computing system 200 (e.g., the remote service arrangement system) and the vehicle monitoring system 250.

In some examples, the service application 206 can obtain local device data 209 by interfacing with different components of the provider device 202. In particular, the service application 206 can obtain one or more of (i) environmental data 209A from one or more environmental sensors 208A (e.g., barometric sensor, altimeter, thermometer, light sensor, image sensor, microphone, etc.), (ii) motion sensing data 209B from one or more motion sensing sensors 208B, such as an accelerometer (e.g., a 3-axis accelerometer) and/or a gyroscope (or an inertial measurement unit (IMU) as a combination of gyroscope and accelerometer), and (iii) position data 209C (alternatively shown as current location 207 when used in connection with the transport arrangement service) as provided by a position determination component (e.g., GPS) of the provider device 202. The service application 206 can trigger the provider device 202 to transmit the local device data 209 to the network computing system 200. Depending on implementation, the transmission of local device 209 to the network computing system 200 may occur periodically (e.g., such as on a schedule), randomly, and/or responsive to a particular event or condition (e.g., poor feedback, low rating after provider provides service).

The vehicle monitoring system 250 can receive the local device data 209 via the provider device interface 226. The vehicle monitoring system 250 uses the set of local device data 209 in determining a set of characterizations 245 which relate to any one or more of (i) a quality (e.g., comfort of transport) of the service that can be offered by the vehicle in its current state, (ii) a type or service level which can be provided with the vehicle, (iii) a maintenance level of the vehicle, indicating information such as whether maintenance on the vehicle is needed, or is likely to be needed in the near future, and/or (iv) a performance or safety level of vehicle.

According to some examples, the vehicle monitoring system 250 includes a comparator 230 that compares sensor values from the vehicle with one or more sets of baseline values 231. The comparator 230 may include profile logic 234 to map sensing values of the local device data 209 with position and/or time, so that sensor profiles of specific types (e.g., accelerometer sensor profile) can be generated and synchronized with sensor profiles of other types with respect to time, or with respect to vehicle location. The profile logic 234 may use the local device data 209 to generate one or more profiles 239 for one or multiple types of sensor data, over time and/or position. For example, the profile logic 234 can map sensor values determined from an accelerometer and/or gyroscope of the provider device 202 (as provided by the motion sensing data 209B) over time and/or vehicle position to determine an acceleration profile the vehicle from within the cabin (e.g., at or near the front seat or back seat). In determining a given sensor profile 239, the sensor values may be filtered to identify instances when a desired characteristic of the vehicle is most determinable or indicative of a particular vehicle characterization 245. For example, with respect to the vehicle's idle vibrational characteristic, the comparator 230 can implement the profile logic 234 to select accelerometer data (from motion sensing local device data 209B) that is synchronized by time or position to a location where the vehicle is deemed to have come to a prolonged stop (e.g., at a red light). The comparator 230 can process sensor readings from the motion sensors 208B as profiled over time, to determine, for example, the shape of the vibrational pattern, the magnitude of the vibrations (e.g., corresponding to the accelerometer values), the average vibrational value, and whether the vehicle vibration is constant or fluctuating.

The comparator 230 can utilize other types of sensor profiles 239, which can be determined from the local device data 209 of the provider device 202, to determine pitch, roll or yaw at certain instances, such as when a sudden deceleration occurs (e.g., the provider brakes). Sensor values reflecting such movements by the vehicle can be identified selectively, using, for example, the position data. For example, the comparator 230 can implement the profile logic 234 to identify acceleration data from the local device data 209, corresponding to when the vehicle is being driven down a steep hill (e.g., as indicated by cross-referencing the position data 209C with a topographical roadway map). The acceleration data can be monitored for data which indicates a degree of pitch the vehicle experiences when maneuvering down the steep hill and coming to a stop.

As another example, the profile logic 234 can generate the acceleration profile 239 to identify values of acceleration and/or gyroscope data, reflecting a road segment in the vehicle's navigation where the vehicle turns about a corner or travels on a winding road. The comparator 230 can analyze the acceleration profile 239 to the roll and yaw the vehicle experienced.

As another example, the microphone of the provider device 202 may be turned on to obtain audio of the vehicle traversing on a roadway. The profile logic 234 can map the audio signals over time and position to determine the magnitude, pitch, and/or type of audio that is detectable from within the cabin while the vehicle is in operation. The provider device 202 can include a filtering module (not shown) that filters out audio not related to noise caused by the operation of the vehicle in order to protect the privacy of the driver and rider.

In this way, multiple sensor profiles 239 may be developed for the vehicle as a function of position and time, to reflect a variety of vehicle characteristics, such as cabin vibration, propensity for the vehicle to pitch, propensity for the vehicle to experience roll or yaw, and cabin noise. The comparator 230 can evaluate the sensor profiles 239 to determine the set of characterizations 245 for the vehicle.

In some examples, the comparator 230 generates the characterizations 245 for the vehicle by comparing one or more sensor profiles 239 to individual corresponding baseline values 231 in order to determine a set of one or more characterizations 245 which are relevant to use of the vehicle for the transport related services. For the vehicle of the given provider, the baseline values 231 may be determined from corresponding sensor measurements of, for example, any one or more of (i) similar vehicles (e.g., by age, type, manufacturer etc.), (ii) ideal or desirable vehicles (e.g., highly-maintained vehicle) of a same type, and/or (iii) a normalization of values from vehicles of the same type (e.g., average values for vehicles of same type). The comparator 230 can implement processes to compare the sensor profiles 239 to the baseline values 231, in order to identify instances in which one or more of the sensor profiles 239 indicate anomalies and/or non-anomalies. The comparison between the sensor profiles 239 and the baseline values 231 can be statistical, to identify, for example, when the sensor profiles 239 indicate the vehicle under analysis is near or outside of a standard deviation. Still further, in some examples, the comparison of a sensor profile 239 to a baseline value 231 can be deemed either sufficiently similar or anomalous, based at least in part on a statistical deviation amongst a similar group of vehicles.

In some examples, the vehicle monitoring system 250 utilizes a library of baseline values 231, each of which providing a quantitative representation of sensor values or states of a characterization or aspect thereof. A baseline determination component 232 can select a set of baseline values for the comparator 230 to use against one or more sets of sensor profiles 239, based on, for example, the provider identifier, the type of vehicle (which may be determined from the profile store 222), the road segment, the road condition, or other selection criteria.

In variations, the comparator 230 can implement processes to determine characterizations 245 based on a mathematical (e.g., distance-based) comparison of the sensor profiles 239 to baseline values 231. In such examples, the comparisons to the baseline values 231 can be binary (e.g., anomaly or non-anomalous), with anomalous determinations being based on a pre-determined threshold difference that is indicative of a particular characterization 245. The threshold for determining when the comparison is similar or anomalous can be specific to design implementation.

In some variations, the difference between the sensor profile 239 of the vehicle and the baseline values 231 may also be scored, to reflect a degree of closeness between individual or aggregated sensor profiles 239 and the baseline values 231. For example, the degrees of closeness may be based on a distance measurement, to reflect when the sensor profile 239 is either a likely match, possible match, or unlikely match to one of the baseline profiles 231. The degree of closeness may in turn, reflect one of multiple possible characterizations 245. By way of example, the comparator 230 can identify when the vibration pattern of the vehicle is severe in magnitude as compared to the baseline values 231, where the baseline values determine what would be considered normal for the particular type of vehicle. As an addition or variation, the comparator 230 can compare the vibration pattern to one or more baseline values 231 to identify when the vibration pattern is erratic, so as to be indicative of a problem with the vehicle. Based on a comparison of the vibration profile, the comparator 230 can generate one or more characterizations 245 for the vehicle with regards to, for example, performance, a specific or general malfunction or servicing, a degradation level of the vehicle, and/or a comfort level of the vehicle.

In similar fashion, the profile logic 234 can generate the sensor profile 239 for the movement data 209B, which the comparator 230 can compare against baseline values 231 to determine, for example, characterizations 245 of the vehicle that are specific to a braking function, a traction value, a steering function, a drive train, and other characteristics of the vehicle.

In some examples, the baseline values 231 or based on historical values from the same vehicle. In comparing the sensor data profiles to baseline values 231 originating from the same vehicle, the comparator 230 can identify differences, either by value range or by threshold determinations, which that are indicative of degradation in the vehicle in a manner that affects a previous characterization 245 of the vehicle.

As an addition or alternative, the comparator 230 can compare the audio profile as determined from the vehicle microphone to baseline values 231 in order to determine one or more characterizations 245 for the vehicle. For example, the magnitude, sound wave shape or pattern and/or frequency can be compared to the baseline values 231 in order to determine when the audio profile includes a pattern or marker that is indicative of a particular characterization 245.

In some examples, the comparator 230 includes a classifier 236, which can classify the vehicle based on one or more sensor profiles 239. Accordingly, the characterizations 245 may include one or more classifications 233. The classifier 236 may, for example, determine one or more classifications 233 of the vehicle, corresponding to a type (e.g., luxury sedan, hybrid vehicle, electric vehicle) or make of the vehicle, an age of the vehicle, a service or maintenance level of the vehicle, and/or a comfort level of the vehicle. The classifier 236 may determine the classification 233 based on, for example, a feature set that includes a quantitative set of values that represent the anomalies between the sensor profiles of the vehicle and those of select baseline values.

In some examples, the classifier 236 can also utilize image data to determine a classification 233 such as the make and model of the vehicle, or the cleanliness of the vehicle. For example, the service application 206 may execute on the provider device 202 to cause an image capturing component of the device to capture an image of the passenger cabin. The classifier 236 can compare the image to a library of sample images to determine the classification (e.g., make and model, cleanliness, etc.)

In some variations, the baseline values 231 can predefine vehicles by any one of multiple categories (e.g., desirability for transport). For example, the baseline values 231 can identify desirability categories for poor, good and excellent, with respect to one or more of (i) the amount of vibration present within the vehicle, and/or (ii) the amount of noise present within the vehicle. Based on the comparison to the baseline values 231, the comparator 230 can determine one or more predefined vehicle characterizations 245 that correspond to a predefined category of vehicle operation.

In some implementations, the baseline values 231 can, for example, define a baseline profile of how a vehicle of the same type with a certain characteristic (or combination of characteristics) is expected to perform. By way of example, the baseline values 231 may reflect engine deterioration by identifying how a vehicle engine vibrates, sounds, or performs after operating for a period of time (e.g., 1 year, 3 years, 5 years etc.) under normal care operating conditions. Similar baseline values 231 can be determined for one or multiple types of sensor profiles to model engine or vehicle performance when vehicle damage exists, such as to crankshafts, cylinder shafts, etc. If the comparator 230 determines there is similarity between the relevant sensor profiles of the vehicle and those baseline values 231 that model specific vehicular problems, the characterizations 245 of the vehicle monitoring system 250 can identify the potential problem of the vehicle.

In some implementations, the comparator 230 can implement a process, combination of processes, or other logic which serves to modify, normalize, sort, filter, and/or select data sets of trips that can refine the local device data 209 of the provider device 202. For instance, the comparator 230 may have access to or include known information, such as a reported make, model, and mileage of the given vehicle (e.g., via a provider profile). The comparator 230 may also utilize contextual information, such as provided by road conditions 256 and/or weather conditions 254 at the sensor profiles are determined. The comparator 230 can use the contextual information and/or known vehicle information to, for example, normalize the local device data 209, and to provide a more accurate vehicle characterization 245.

In some examples, the vehicle monitoring system 250 can include a task manager 246 to initiate or implement an action or workflow based on the determined vehicle characterization 245. The task manager 246 can implement logic (e.g., rule based logic) that results in the vehicle monitoring system 250 performing an action, series of actions, or taking no action. In some examples, the task manager 246 updates the profile information 225 of the provider with the characterizations 245 of the vehicle monitoring system 250. For example, the task manager 146 may store a quality value for the vehicle with the provider's profile 225, based on one or more characterizations 245. Depending on implementation, the quality value can reflect, for example, an overall comfort level of the vehicle, a state of the vehicle's maintenance, a performance level of the vehicle, and/or a safety level of the vehicle. In variations, the task manager 246 can store the classification 233 of the vehicle with the provider's profile 225, such as, for example, the make, model, type or age of the vehicle.

In some variations, the task manager 246 includes a communication workflow 248, which can include process(es) for communicating a notification 249 for the provider regarding the vehicle characterizations 245. For example, the task manager 246 may map certain kinds of vehicle characterization 245 to notification content 253 selected from a content library 255. The task manager 246 can implement the provider communication workflow 248 to send the provider a notification 249, where the notification 249 includes the notification content 253. In sending the notification 249, the communication workflow 248 can utilize the provider interface 226 (e.g., in-app notification), or an alternative communication transport (e.g., Short Message Service (SMS), email). In such examples, the notification content 253 can provide information to the provider based on the characterizations 245. For example, the notification content can include a list of potential and actual problems the provider has with the vehicle, and/or a list of actions which the provider can perform in order to improve the suitability of the vehicle for providing service through the transport system 80. For example, the notification 249 can include a list of actions which the provider can implement in order to make the ride more comfortable to a passenger, based on characterizations 245 regarding the vibration and/or audio level of the vehicle interior.

In other variations, the system task manager 246 may implement the communication workflow 248 to prompt and monitor for responses to the notification 249. For example, the task manager 246 may implement the communication workflow 248 to monitor a message store (e.g., provided with the provider interface 210) for a reply message from the provider.

Still further, in order variations, the system task manager 246 may implement the communication workflow 248 to prompt the provider to perform an action, and to monitor a third-party resource for performance of the action by the provider. For example, the task manager 246 may implement the communication workflow 248 to prompt the provider associated with the vehicle to seek or perform a vehicle maintenance check with a third-party service based on one or more detected engine performance anomalies.

Although the example of FIG. 2 is described above with respect to the network computing system 200 being implemented remotely from a user's computing device, in other examples, one or more of the components of the network computing system 200 can be implemented by the user's computing device or service application 206. For example, the service application 206 can process the sensor data to determine a sensor profile that is indicative of a condition, classification or problem with the vehicle.

Still further, the service application 206 may execute to determine vehicle characteristics by comparing the local device data 209 to baseline values, or baseline profiles that are determined by the provider device 202 for the vehicle over time. In such examples, the service application 206 may generate or store the baseline values, and trigger the provider with notifications in order to cause the provider to implement preventative or remedial actions with respect to the vehicle.

While examples are discussed which focus on obtaining and using local device data 209 from the provider device 202, some examples also provide for utilizing other mobile computing devices which may be carried within an interior, or in close proximity to a vehicle that is to be evaluated. In the context of transportation arrangement services, some examples may provide for the requester device 204 to be triggered to obtain and transmit suitable sensor-based information for evaluating the performance of a vehicle. For example, the requester device 204 may be triggered to obtain the sensor-based information as confirmation of sensor-readings of the provider device 202. In an example shown, the requester device 204 may operate to obtain local device data 209 from a backseat of the vehicle. The requester device 204 may then transmit the local device data 209 to the network computing system 200. Depending on implementation, the requester device 204 may transmit the local device data 209 to the network computing system 200 in real-time (e.g., as the data is being acquired on the requester device 204), or at a later time (e.g., when the trip is complete). The vehicle monitoring system 250 may, for example, utilize a trip monitor 238 to determine when a given requester is on a trip in a specific vehicle. At select moments in the requester's trip, the requester's device 204 may operator to obtain the local device data 209 for the vehicle monitoring system 250.

Methodology

Figure 3:
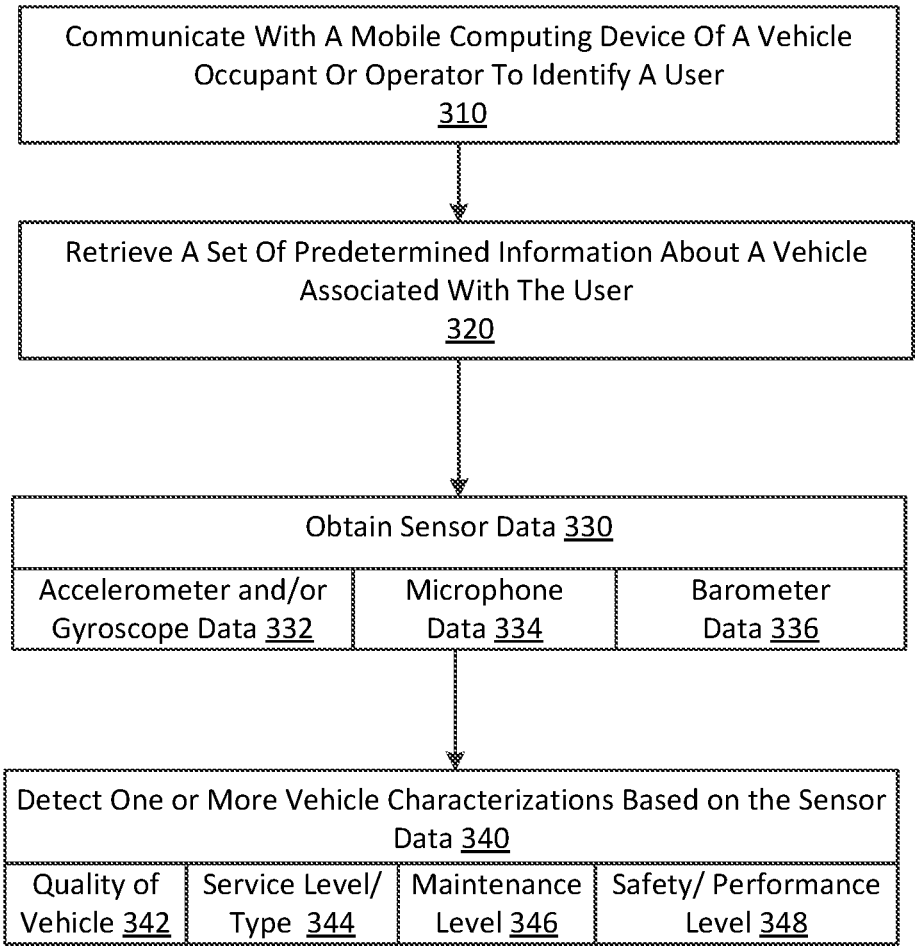
FIG. 3 illustrates an example method, in accordance with an embodiment, for determining a characterization of a vehicle using sensor data provided from a mobile computing device.

FIG. 3 illustrates an example method for determining a set of vehicle characterizations based on sensor data provided from a mobile computing device which is in operative vicinity to the vehicle. A method such as described by an example of FIG. 3 can be implemented using, for example, components described with the examples of FIGS. 1 and 2. Accordingly, references made to elements of FIG. 1 or FIG. 2 are for the purposes of illustrating a suitable element or component for performing a step or sub-step being described. For illustrative purposes, FIG. 3 can be described as being performed by network computing system that is remote to the mobile device that is in operative vicinity of the vehicle. In variations, some steps or sub-steps of an example off FIG. 3 can be performed on the mobile device, using, for example, a service application that is controlled by the network computing system 200.

Referring to FIG. 3, vehicle monitoring system 100, 250 can communicate with a mobile computing device of a vehicle occupant or operator to identify a user (310). In some examples, the user is a service provider, such as a driver, operating in connection with a transport arrangement service (e.g., such as described with an example of FIG. 2). For example, the user may correspond to a service provider who provides transport services using their own vehicle.

The vehicle monitoring system 100, 250 can retrieve a set of predetermined information about a vehicle associated with the user (320). For example, the user may be associated with an account and/or profile information, which includes information about the vehicle the user operates when providing transport services. The information about the vehicle may include, for example, a make or model of the vehicle, information indicating a maintenance state of the vehicle (e.g., based on prior evaluations conducted through the vehicle monitoring system 100, 250.

According to some examples, the vehicle monitoring system 100, 250 obtains sensor data of one or more types (330) through execution of the service application on the mobile computing device of the user. Each type of sensor data can originate from a specific sensor of the mobile computing device. For example, the mobile computing device can include logic (e.g., service application 206) to read different types of sensor data from sensor components such as an accelerometer and/or gyroscope (332), a microphone (334) and/or a barometer (336). In some variations, the different types of sensor data can also be communicated from multiple computing devices of occupants and/or operators of the vehicle. For example, in the context of a transport related service, the requester device 204 can also include logic to obtain and transmit sensor data to the vehicle monitoring system 100, 250.

In some examples, the vehicle monitoring system 100, 250 can operate to detect one or more vehicle characterizations 32, 145 based at least in part on the predetermined information about the vehicle, and sensor data provided from the mobile computing device (340). In some examples, the characterizations 132, 245 may reflect a quality (e.g., comfort of transport) of service that can be offered by the vehicle in its current state (342). In variations, the characterizations 132, 245 can reflect a service type or service level which can be provided with the vehicle (344). Still further, the characterizations 132, 245 can reflect a maintenance level of the vehicle, indicating information such as whether maintenance on the vehicle is needed, or is likely to be needed in the near future (346). As an addition or alternative, the characterizations 132, 245 can reflect a performance or safety level of the vehicle (348). Specific examples of characterizations affecting, for example, the quality of service type which may be offered by the vehicle include determinations of the vehicle type (e.g., luxury sedan), make and/or model and/or age of vehicle.

Hardware Diagram

Figure 4:
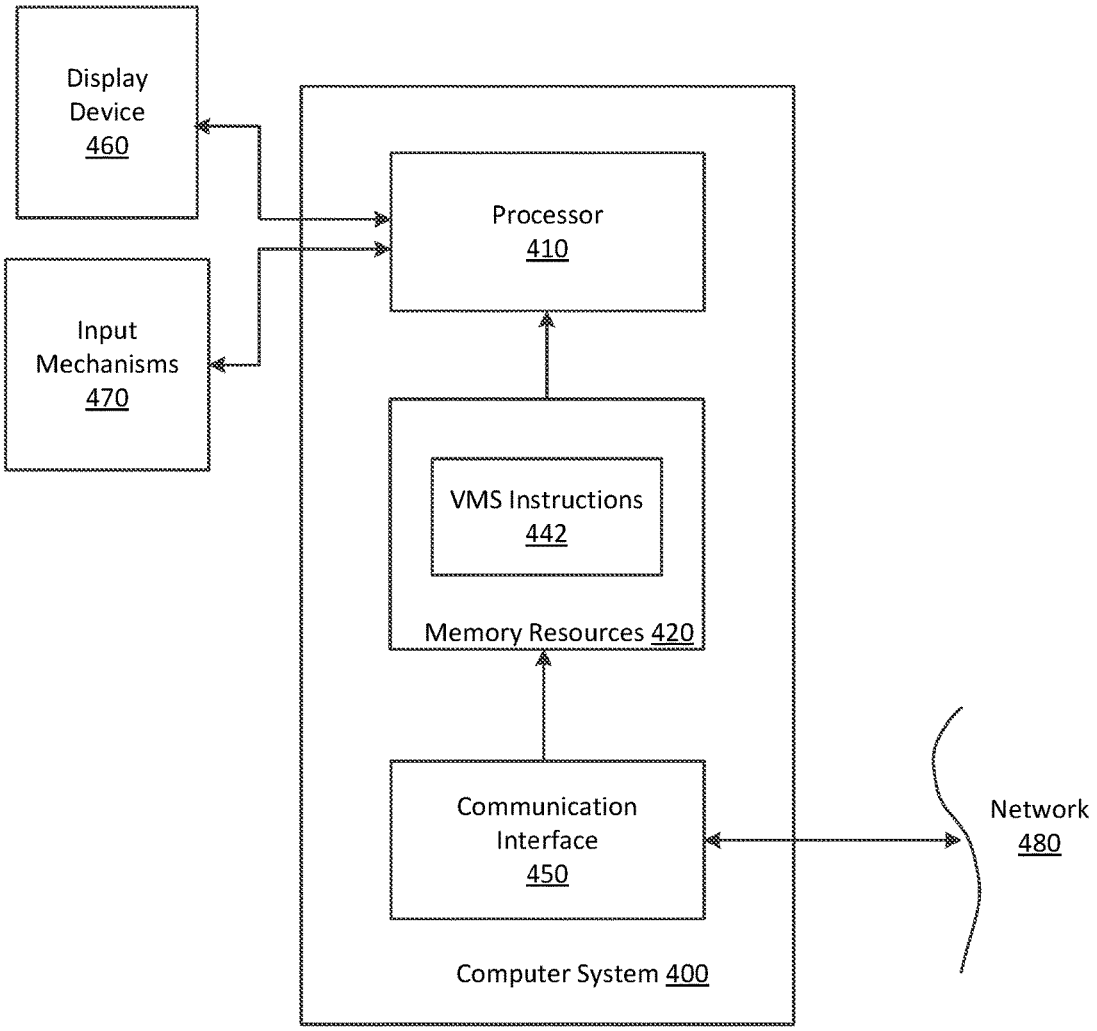
FIG. 4 illustrates a block diagram, in accordance with an embodiment, that illustrates a computer system upon which embodiments described herein may be implemented

FIG. 4 is a block diagram that illustrates a computer system 400 upon which embodiments described herein may be implemented. For example, the computer system 400 may be used to implement the vehicle monitoring system 100, 250 as shown and described with examples of FIG. 1 and FIG. 2.

The computer system 400 includes at least one processor 410 for processing information, and memory resources 420, including random access memory (RAM) and/or other dynamic storage device, for storing information and instructions to be executed by the processor 410. By way of example, the memory resources 420 may also may be used for storing temporary variables or other intermediate information generated during execution of instructions by the processor 410. The computer system 400 may also include other forms of memory resources 420, such as a storage device for storing static information and instructions for the processor 410. The memory resources 420 may store information and instructions, including instructions 442 for implementing vehicle monitoring system 100, 250, as shown by examples of FIG. 1 and FIG. 2. Additionally, the processor 410 can execute the instructions 442 to implement a method such as described with an example of FIG. 3.

The computer system 400 may include one or more communication interface 450 to enable communications with, for example, provider and/or requester devices 202, 204, over one or more networks 480 (e.g., cellular network) through use of the network link (wireless or wireline). Using a network link, the computer system 400 can communicate with one or more other computing devices and/or one or more other servers or data centers.

The computer system 400 can also include a display device 460, such as a cathode ray tube (CRT), an LCD monitor, or a television set, for example, for displaying graphics and information to a user. One or more input mechanisms 470, such as a keyboard that includes alphanumeric keys and other keys, can be coupled to the computer system 400 for communicating information and command selections to the processor 410. Other non-limiting, illustrative examples of input mechanisms 470 include a mouse, a trackball, touch-sensitive screen, or cursor direction keys for communicating direction information and command selections to the processor 410 and for controlling cursor movement on the display 460.

Examples described herein are related to the use of the computer system 400 for implementing the techniques described herein. According to one embodiment, those techniques are performed by the computer system 400 in response to the processor 410 executing one or more sequences of one or more instructions contained in the memory resources 420. Such instructions may be read into, for example, a main memory from another machine-readable medium, such as the storage device 440. Execution of the sequences of instructions contained in the main memory 420 causes the processor 410 to perform the process steps described herein. In alternative implementations, hard-wired circuitry may be used in place of or in combination with software instructions to implement examples described herein. Thus, the examples described are not limited to any specific combination of hardware circuitry and software.

Figure 5:
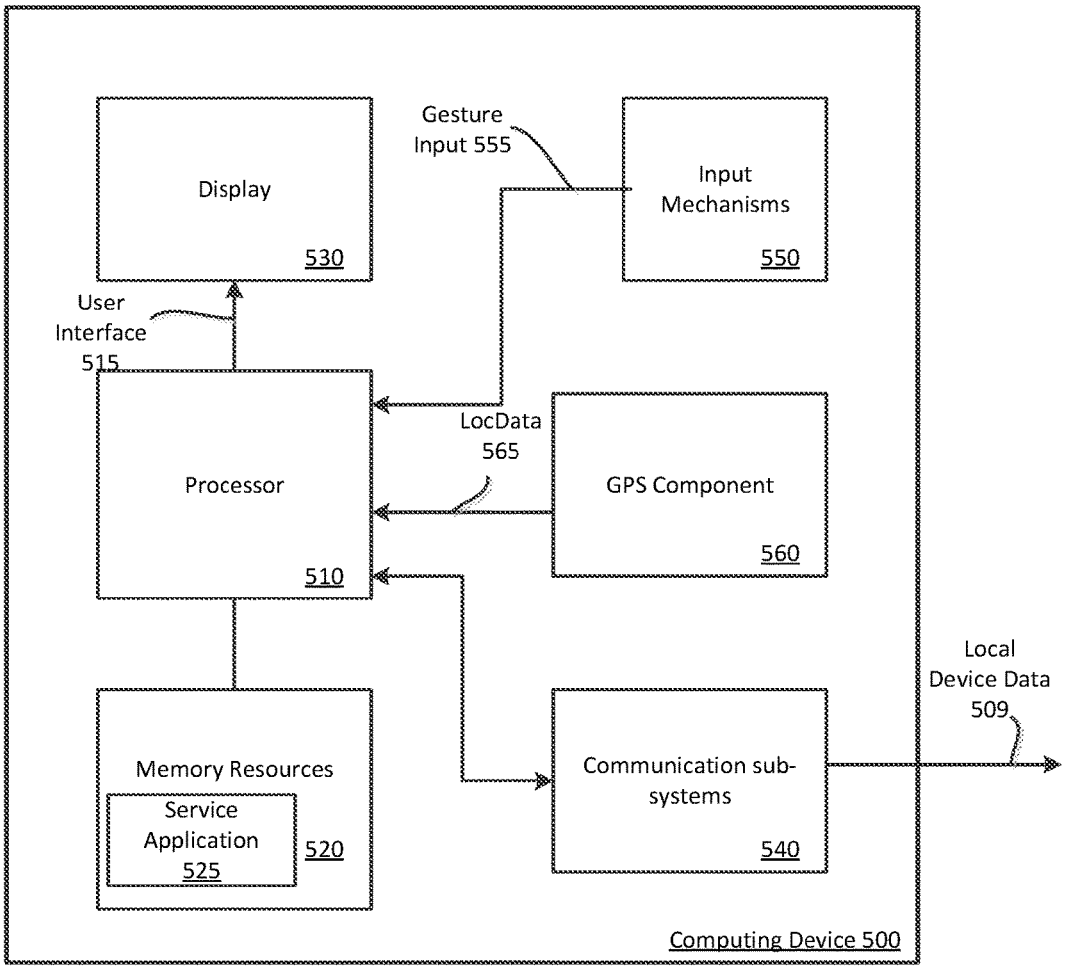
FIG. 5 is a block diagram that illustrates a mobile computing device upon which embodiments described herein may be implemented.

FIG. 5 is a block diagram that illustrates a computing device upon which embodiments described herein may be implemented. In one embodiment, a computing device 500 may correspond to a mobile computing device, such as a cellular device that is capable of telephony, messaging, and data services. The computing device 500 can correspond to a device operated by a requester or, in some examples, a device operated by the service provider that provides location-based services. Examples of such devices include smartphones, handsets, tablet devices, or in-vehicle computing devices that communicate with cellular carriers. The computing device 500 includes a processor 510, memory resources 520, a display device 530 (e.g., such as a touch-sensitive display device), one or more communication systems 540 (including wireless communication systems), a sensor set 550 (e.g., accelerometer and/or gyroscope, microphone, barometer, etc.), and one or more location detection mechanisms (e.g., GPS component) 560. In one example, at least one of the communication systems 540 sends and receives cellular data over data channels and voice channels. The communications systems 540 can include a cellular transceiver and one or more short-range wireless transceivers. The processor 510 can exchange data with a service arrangement system (not illustrated in FIG. 5) via the communications systems 540.

The processor 510 can provide a variety of content to the display 530 by executing instructions stored in the memory resources 520. The memory resources 520 can store instructions for the service application 525. For example, the processor 510 can execute the service application 525 to read sensor data 552 from one or more sensors 550 of the computing device, and to transmit the sensor data 552, along with location data 551 as local device data 509 to a network computing system.

Examples described herein to extend to individual elements and concepts described herein, independently of other concepts, ideas or system, as well as for examples to include combinations of elements recited anywhere in this application. Although examples are described in detail herein with reference to the accompanying drawings, it is to be understood that the concepts are not limited to those precise examples. Accordingly, it is intended that the scope of the concepts be defined by the following claims and their equivalents. Furthermore, it is contemplated that a particular feature described either individually or as part of an example can be combined with other individually described features, or parts of other examples, even if the other features and examples make no mentioned of the particular feature. Thus, the absence of describing combinations should not preclude having rights to such combinations.

What is being claimed is:

1. A method of performing a vehicle evaluation process, the method being performed by one or more processors of a network system and comprising:

retrieving information from a profile associated with a transport service, the retrieved information including a set of predetermined information about a vehicle that is associated with a user;

determining a set of baseline values for the vehicle based on the set of predetermined information about the vehicle;

in response to detecting one or more events associated with the transport service, causing a mobile computing device of the user to transmit, over one or more networks to the network system, sensor data generated by one or more sensors of the mobile computing device when the mobile computing device is carried within or in proximity to the vehicle while the vehicle is operating; and comparing the set of baseline values for the vehicle and the sensor data to determine one or more vehicle characterizations for the vehicle, wherein comparing the set of baseline values and the sensor data includes making one or more binary determinations based on a pre-determined threshold value that is indicative of the one or more determined vehicle characterizations and specific to a design implementation of the vehicle.

2. The method of claim 1, wherein the sensor data reflects an acoustic attribute within an interior of the vehicle.

3. The method of claim 1, wherein the sensor data reflects a movement attribute from within an interior of the vehicle.

4. The method of claim 1, wherein the one or more vehicle characterizations identifies at least one of a service level or a maintenance state of the vehicle.

5. The method of claim 1, wherein determining one or more vehicle characterizations includes determining a degradation level of the vehicle.

6. The method of claim 1, wherein determining the one or more vehicle characterizations includes:

determining a set of sensor profiles from the sensor data, each sensor profile mapping a sensor value to a location or time when the sensor value was captured; and comparing one or more of the set of sensor profiles with corresponding baseline values of the set of baseline values.

7. The method of claim 6, wherein determining the set of sensor profiles includes correlating one or more sensor values with a location of the vehicle on a road segment.

8. The method of claim 7, wherein determining the one or more vehicle characterizations includes determining an activity of the vehicle at a first location, and determining a corresponding characterization that is specific to the determined activity of the vehicle.

9. The method of claim 8, wherein the activity corresponds to idling, and wherein determining the corresponding characterization includes using a sensor profile of an accelerometer to determine a vibration pattern of the vehicle when idling.

10. The method of claim 6, wherein the set of baseline values includes a sensor profile for a same category of vehicle.

11. The method of claim 6, wherein the set of baseline values is based on a classification of the vehicle.

12. The method of claim 1, wherein the set of baseline values includes a sensor profile for a desired vehicle characterization.

13. The method of claim 1, wherein the set of baseline values is based on one or more sets of sensor data which were previously obtained for the vehicle.

14. The method of claim 1, further comprising:

receiving a second set of sensor data from a second mobile computing device associated with an occupant of the vehicle other than the user; and wherein determining the one or more vehicle characterizations is based at least in part on the second set of sensor data received from the second mobile computing device.

15. The method of claim 1, wherein the sensor data includes data generated by one or more of: an accelerometer, a gyroscope, a barometer, or a microphone.

16. The method of claim 1, further comprising storing the one or more determined vehicle characterizations as part of a profile for the user, the user being a service provider for the transport service.

17. The method of claim 1, further comprising sending a notification to the mobile computing device of the user, the notification including information about the one or more determined vehicle characterizations.

18. The method of claim 17, further comprising selecting a content for the notification based on the one or more determined vehicle characterizations.

19. The method of claim 1, further comprising prompting the user to perform a task based on the one or more determined vehicle characterizations.

20. A non-transitory computer readable medium that stores instructions, which when executed by one or more processors of a network system, cause the network system to perform operations comprising:

retrieving information from a profile associated with a transport service, the retrieved information including a set of predetermined information about a vehicle that is associated with a user;

determining a set of baseline values for the vehicle based on the set of predetermined information about the vehicle;

in response to detecting one or more events associated with the transport service, causing a mobile computing device of the user to transmit, over one or more networks to the network system, sensor data generated by one or more sensors of the mobile computing device when the mobile computing device is carried within or in proximity to the vehicle while the vehicle is operating; and comparing the set of baseline values for the vehicle and the sensor data to determine one or more vehicle characterizations for the vehicle, wherein comparing the set of baseline values and the sensor data includes making one or more binary determinations based on a pre-determined threshold value that is indicative of the one or more determined vehicle characterizations and specific to a design implementation of the vehicle.

* * * * *